US006105349A

United States Patent [19]

Busboom et al.

[11] Patent Number: 6,105,349

[45] Date of Patent: Aug. 22, 2000

[54] RIDING LAWN MOWER HAVING A LIQUID-COOLED ENGINE

[75] Inventors: Garry W. Busboom; Gary L. Nicholson, both of Beatrice, Nebr.

[73] Assignee: Exmark Mfg Co., Inc., Beatrice, Nebr.

[21] Appl. No.: 09/187,590

[22] Filed: Nov. 6, 1998

[51] Int. Cl.[7] ..... A01D 34/40

[52] U.S. Cl. ..... 56/14.7; 56/16.7; 180/68.6

[58] Field of Search ..... 180/68.4, 68.6, 180/68.1; 56/14.7, 16.7, DIG. 22

[56] References Cited

U.S. PATENT DOCUMENTS

| | | | |
|---|---|---|---|
| 4,579,090 | 4/1986 | Konrath et al. | 180/68.4 X |
| 4,589,379 | 5/1986 | Fujikawa et al. | 123/41.49 |
| 4,862,981 | 9/1989 | Fujikawa et al. | 180/68.4 |
| 5,199,521 | 4/1993 | Samejima et al. | 180/68.1 |
| 5,284,115 | 2/1994 | Imanishi et al. | 123/41.7 |
| 5,678,648 | 10/1997 | Imanishi et al. | 180/68.1 |

*Primary Examiner*—H. Shackelford
*Attorney, Agent, or Firm*—Zarley, McKee, Thomte Voorhees & Sease; Dennis L. Thomte

[57] ABSTRACT

A lawn mower including a liquid-cooled engine having a radiator grille positioned over the radiator thereof. The radiator grille includes a perforated screen member having a series of alternating grooves and ridges formed therein which run downwardly and rearwardly from the forward end of the screen member. The design of the screen member and the radiator grille permit the perforated screen member to self-clean and also provides a convenient means by which the screen member may be manually cleaned, if necessary.

12 Claims, 3 Drawing Sheets

RIDING LAWN MOWER HAVING A LIQUID-COOLED ENGINE

BACKGROUND 0F THE INVENTION

1. Field of the Invention

This invention relates to a riding lawn mower having a liquid-cooled engine. More particularly, this invention relates to a unique radiator grille for a riding lawn mower having a liquid-cooled engine.

2. Description of the Related Art

Riding lawn mowers generally comprise a frame having drive wheels mounted thereon at the opposite sides thereof for driving and steering the mower. Normally, the engine for the mower is mounted on an engine deck behind the operator's station and is usually of the air-cooled type due to the fact liquid-cooled engines are more expensive than air-cooled engines. Further, if a liquid-cooled engine is used, the radiators therefore become clogged with grass clippings or chaff. Liquid-cooled engines are more desirable than air-cooled engines due to the fact that the operating temperatures thereof tend to be more consistent and tend to be lower than is experienced in air-cooled engines. The liquid-cooled engines usually have a longer life than air-cooled engines and generally require less maintenance. Additionally, liquid-cooled engines are usually built to tighter clearances or tolerances than is possible with an air-cooled engine. Also, liquid-cooled engines are normally quieter, produce lower emissions and have better fuel economy than air-cooled engines. However, due to the problems associated with the collection of chaff on the radiators of the liquid-cooled engines, liquid-cooled engines have not been successfully employed on lawn mowers.

SUMMARY OF THE INVENTION

A riding lawn mower is disclosed and includes a frame having drive wheels rotatably mounted thereon for driving and steering the lawn mower. An operator's station is provided on the frame forwardly of the rearward end thereof and a mower deck is supported by the frame at the forward end thereof. At least one cutting blade is rotatably disposed within the mower deck in conventional fashion. The frame has an engine support deck provided thereon at the rearward end thereof behind the operator's station. A liquid-cooled engine is mounted on the engine deck and has a radiator operatively connected thereto for cooling the liquid in the engine. The radiator is disposed at an angle above the engine so that the forward end of the radiator is disposed above the rearward end of the radiator. A radiator grille is removably positioned above the radiator for allowing the flow of cooling air downwardly therethrough towards and through the radiator. The radiator grille includes a perforated screen member having perforations formed therein. The perforated screen member is corrugated and includes a series of alternating, elongated grooves and ridges. The grooves and ridges of the perforated screen member are disposed parallel to the normal forward directional movement of the lawn mower. The perforated screen member is inclined with respect to the horizontal so that the grooves and ridges thereof extend downwardly and rearwardly from their forward ends to their rearward ends. The radiator grille has an opening formed therein in which the perforated screen member is positioned. The radiator grille includes a corrugated portion at the bottom edge of the opening formed therein with the corrugated portion of the radiator grille including a series of alternating grooves and ridges which register with the grooves and ridges in the screen member.

The lower rearward ends of the grooves and ridges of the screen member rest upon the grooves and ridges of the corrugated portion of the radiator grille so that accumulated chaff in the grooves and ridges will fall therefrom, by gravity and vibration.

It is therefore a principal object of the invention to provide a lawn mower including a liquid-cooled engine.

Still another object of the invention is to provide a lawn mower including a liquidcooled engine including a novel perforated grille member which not only permits accumulated chaff thereon to fall therefrom, by gravity and vibration, but which also is easily cleaned by the operator.

Still another object of the invention is to provide a riding lawn mower including a liquid-cooled engine having a novel radiator grille associated therewith which may be pivoted from an operative position to a service or open position.

Yet another object of the invention is to provide a perforated grille for a liquidcooled lawn mower which is economical of manufacture, durable in use and refined in appearance.

These and other objects will be apparent to those skilled in the art.

DESCRIPTION OF THE PREFERRED EMBODIMENT

Figure 1:
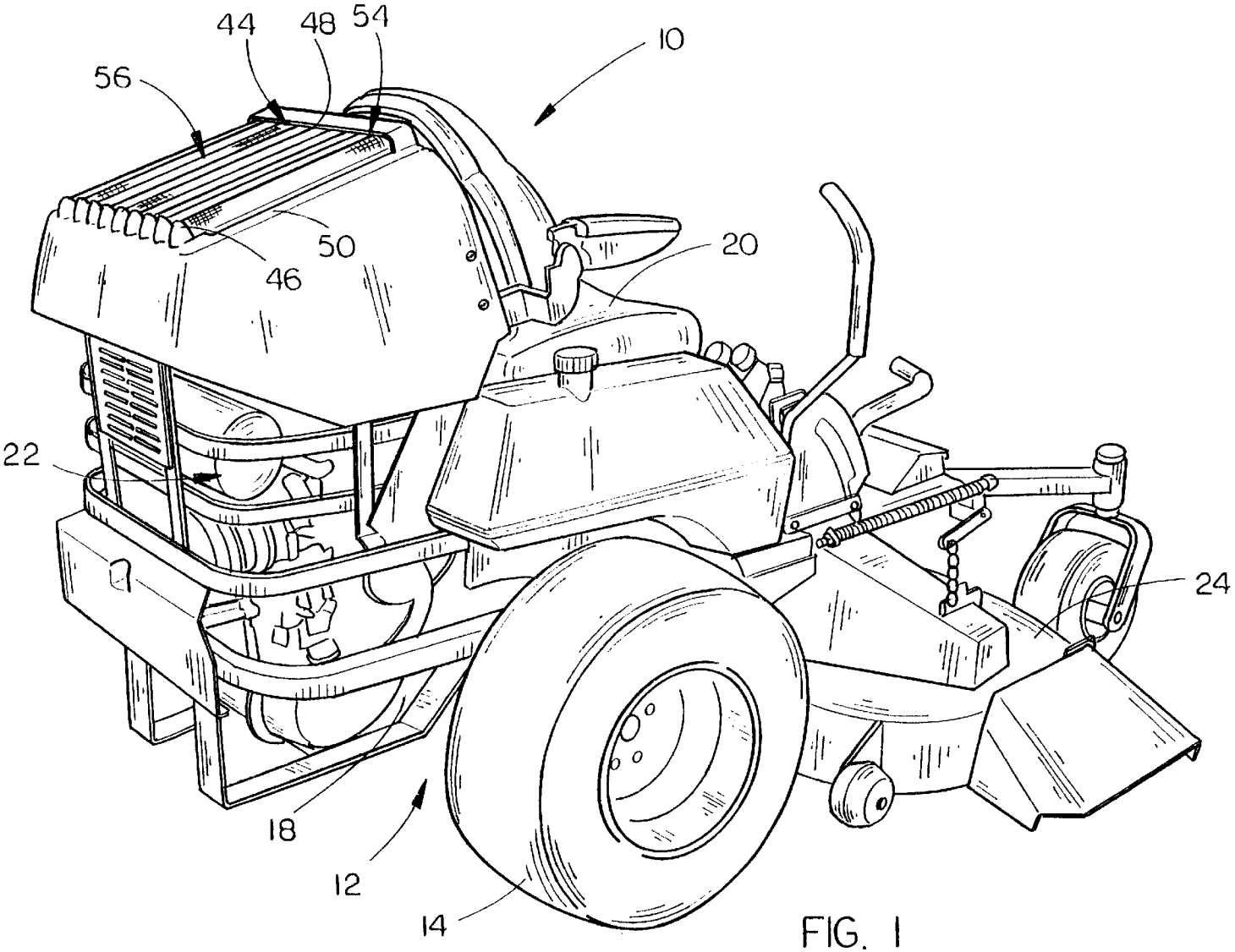
FIG. 1 is a rear perspective view of a riding lawn mower having a liquid-cooled engine including a novel radiator and radiator grille.

The mower of this invention is referred to generally by the reference numeral 10 and is seen to be a riding lawn mower. Although the invention described herein is ideally suited for use with a riding mower, it is believed that the invention described herein also has applicability with respect to walk-behind mowers or any application where the radiator is subjected to grass or other biological material that could clog the radiator. Mower 10 includes a frame means 12 having a pair of drive wheels 14 and 16 positioned on opposite sides of the frame means 12 at the rearward end of the mower. Mower 10 includes an engine support deck 18 which is located behind the operator's station referred to generally by the reference numeral 20. A liquid-cooled engine 22 is mounted on engine support deck 18 and is operatively connected to the drive wheels 14 and 16 in conventional fashion to drive and steer the mower. Mower 10 includes a mower deck 24 at the forward end thereof which houses one or more cutting blades therein which are driven in conventional fashion by the engine 22.

The numeral 26 refers to a radiator for the liquid-cooled engine 22 and which is operatively fluidly connected thereto for cooling the liquid in the engine. As seen in the drawings, radiator 26 is disposed at an angle which results in the forward end 28 of radiator 26 being disposed above the rearward end 30 of the radiator.

Figure 2:
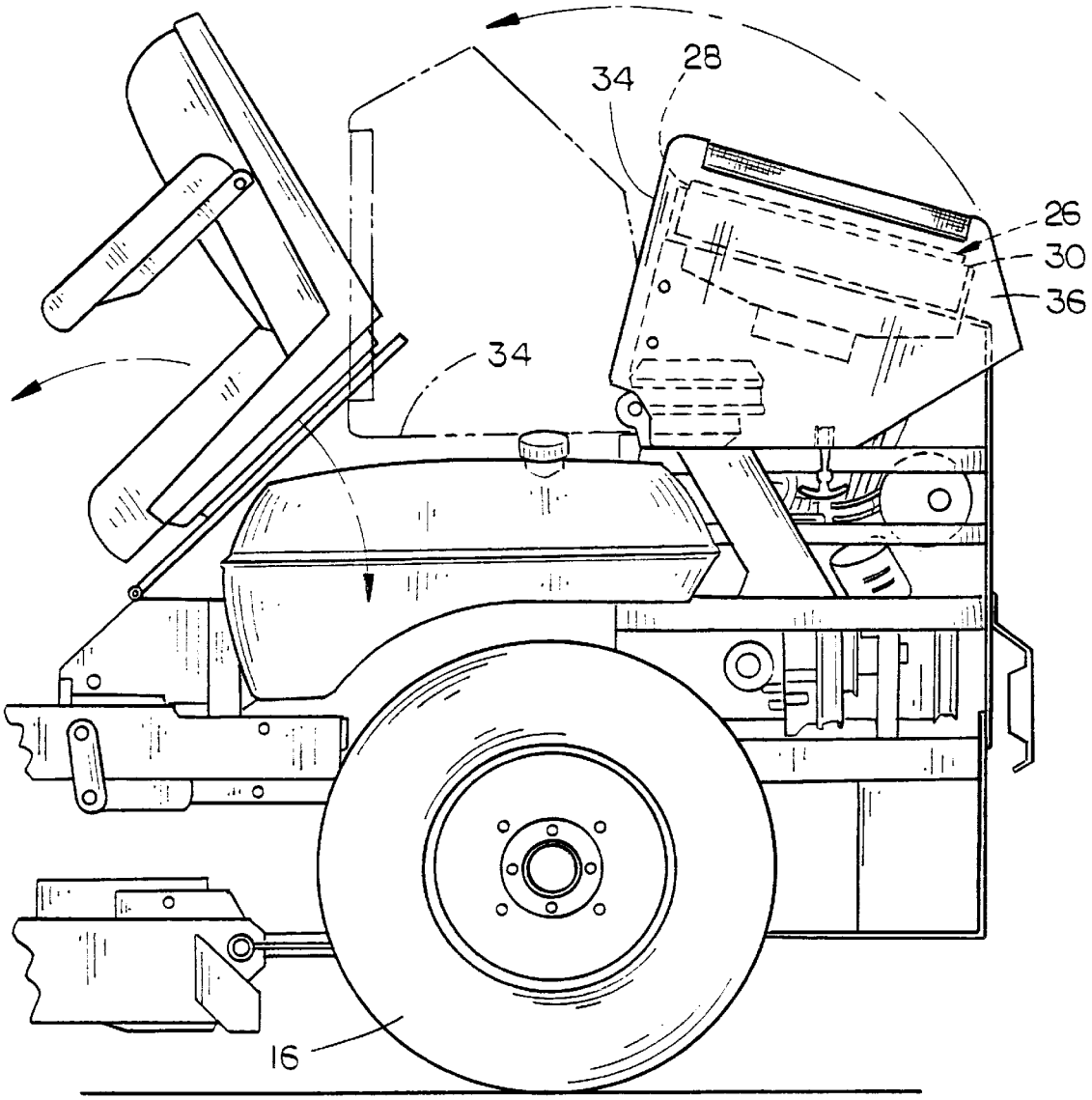
FIG. 2 is a partial side view of the mower with the operator's seat pivoted forward and with broken lines illustrating the open or service position of the radiator grille.
Figure 3:
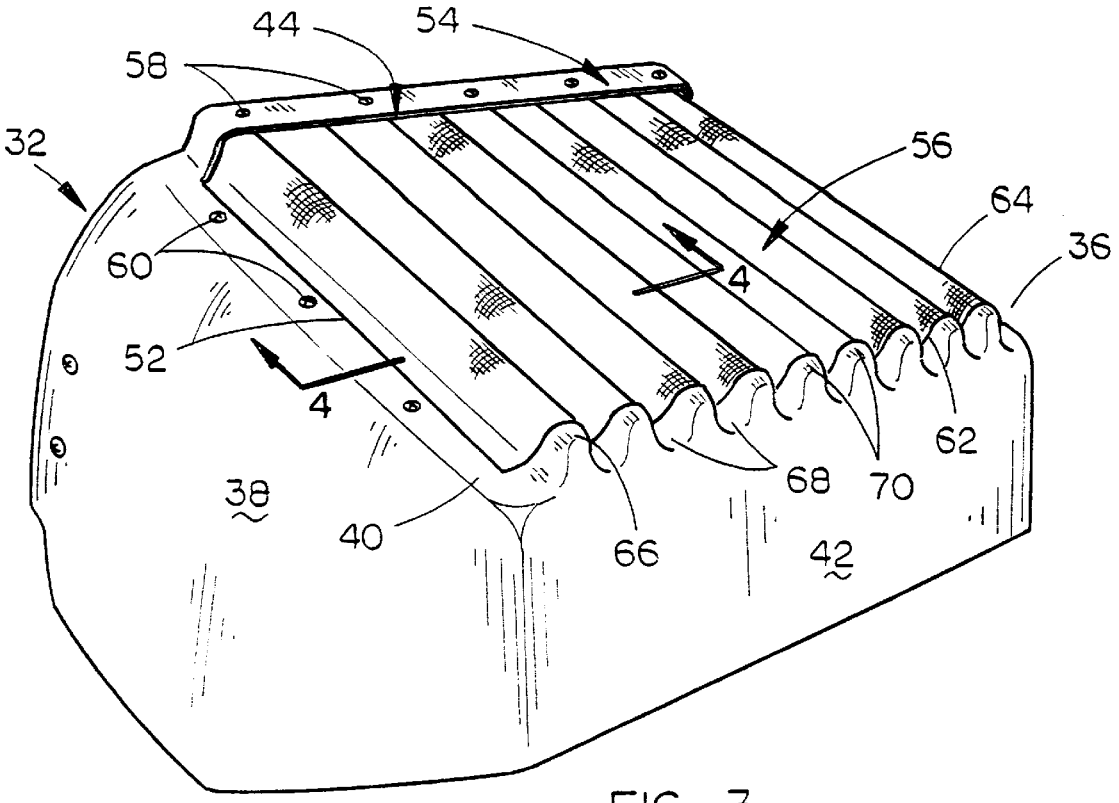
FIG. 3 is a rear perspective view of the radiator grille of this invention.
Figure 4:
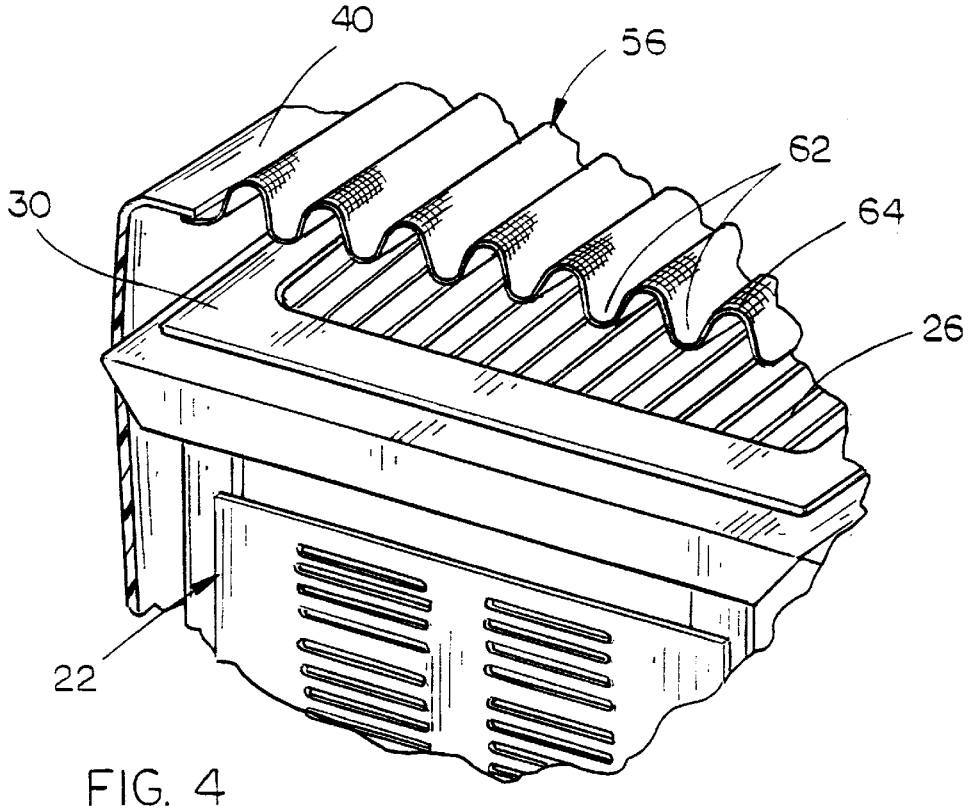
FIG. 4 is an enlarged sectional view as seen on lines 4–4 of FIG. 3.

A radiator grille 32 is pivotally mounted on the frame means 12 so that it may be pivoted from the operative position illustrated in FIG. 1 to the open or service position illustrated by broken lines in FIG. 2. For purposes of description, radiator grille 32 will be described as including a front wall 34, side walls 36 and 38 which extend downwardly from opposite sides of top wall 40, and rear wall 42.

An opening 44 is formed in top wall 40 and defines a rearward edge 46, forward edge 48, and opposite side edges 50 and 52. Support frame member 54 is provided at the upper end of opening 44 and is designed to have the upper end of a perforated screen member 56 secured thereto by bolts or screws 58. The sides of the perforated screen member 56 are secured to the radiator grille 32, as seen in the drawings, by screws or bolts 60. Screen member 56 includes a series of alternating grooves 62 and ridges 64 which extend downwardly and rearwardly from the upper to lower ends thereof, as seen in the drawings. The lower or rearward end of top wall 40 is provided with a corrugated portion 66 which is defined by a series of alternating grooves 68 and ridges 70. As seen in the drawings, the lower ends of grooves 62 and ridges 64 of screen member 56 rest upon grooves 68 and ridges 70, respectively, so that an unobstructed path is provided at the lower ends of the grooves 62 and ridges 64 which will enable accumulated chaff to fall therefrom, by gravity and vibration. Further, any accumulated chaff on the perforated screen member 56 may be easily removed therefrom, whether the engine is running or not, by simply running one's fingers downwardly through the grooves 62 of the screen member 56. The unobstructed flow path at the lower end of the grooves and ridges 62 and 64 permit a large portion of the accumulated chaff to fall therefrom, as stated above.

When the radiator grille 32 is positioned in the operative position (FIG. 1), the perforated screen member 56 will be positioned above the radiator 26 with the cooling air for the engine being drawn therethrough. A seal (not shown) is provided between the radiator 26 and the grille 32 around the periphery of the screen member 56 to ensure that all cooling air is drawn through the screen member 56 and will prevent grass clippings or chaff from accumulating on the radiator 26. When it is desired to service the engine, the radiator grille 32 may be pivoted to the open or service position illustrated by broken lines in FIG. 2.

Thus it can be seen that a novel radiator grille has been provided which enables a liquid-cooled engine to be used on a lawn mower. Further, the unique construction of the perforated screen member 56 not only creates a larger surface area upon which the chaff may accumulate, than would be otherwise possible if the screen member were flat, but also directs chaff to accumulate in the grooves 62 with alternating, unclogged ridge areas 70 and provides a self-cleaning feature. Further, the construction of the screen member permits the screen member to be easily cleaned either while the mower is running or turned off.

It is important to note that the positioning of the radiator above the engine behind the operator's station, with the cooling air being drawn therethrough at that location, is very beneficial in that the location is an area containing less debris to clog the radiator or screen. Further, the location of the radiator as noted provides direct visibility of the radiator when the grille is moved to its open or service position.

Thus it can be seen that the invention accomplishes at least all of its stated objectives.

We claim:

1. A lawn mower, comprising:

a frame means having rearward and forward ends and opposite sides;

drive wheels rotatably mounted on said frame means for driving the lawn mower;

a mower deck supported by said frame means at the forward end thereof;

at least one cutting blade rotatably disposed within said mower deck;

a liquid-cooled engine mounted on said frame means for driving said drive wheels and said cutting blade;

a radiator operatively connected to said liquid-cooled engine for cooling the liquid in said engine;

said radiator being disposed above said engine;

a radiator grille positioned above said radiator for allowing the flow of cooling air downwardly therethrough towards said radiator;

said radiator grille including a perforated screen member having perforations formed therein for allowing the flow of cooling air therethrough and restricting the passage of chaff therethrough;

said perforated screen member being corrugated and including a series of rearwardly extending, alternating, elongated grooves and ridges;

said grooves and ridges having forward and rearward ends;

said perforated screen member being inclined with respect to horizontal from one of said forward and rearward ends to the other of said forward and rearward ends to define a lower end of said grooves and ridges; said perforated screen member being adapted to direct accumulated chaff in said grooves and on said ridges toward said lower end.

2. The lawn mower of claim 1 wherein said grooves and ridges have longitudinal axes which are disposed parallel to the normal forward directional movement of the lawn mower.

3. The lawn mower of claim 1 wherein the forward ends of said grooves and ridges are disposed in a plane above the rearward ends thereof.

4. The lawn mower of claim 1 wherein said radiator grille has an opening formed therein in which said perforated screens member is positioned.

5. The lawn mower of claim 1 wherein said radiator grille is pivotally mounted on said frame means to enable said radiator grille to be pivotally moved from an operative position to an open position.

6. The lawn mower of claim 5 wherein an operator's station is provided on said frame means forwardly of said engine and wherein said radiator grille is positioned over said operator's station when in its said open position.

7. The lawn mower of claim 1 wherein said mower is a riding lawn mower.

8. A lawn mower, comprising:

a frame means having rearward and forward ends and opposite sides;

drive wheels rotatably mounted on said frame means for driving the lawn mower;

a mower deck supported by said frame means at the forward end thereof;

at least one cutting blade rotatably disposed within said mower deck;

a liquid-cooled engine mounted on said frame means for driving said wheels and said cutting blade;

a radiator operatively connected to said liquid-cooled engine for cooling the liquid in said engine;

said radiator being disposed above said engine;

a radiator grille positioned above said radiator for allowing the flow of cooling air downwardly therethrough towards said radiator;

said radiator grille including a perforated screen member having perforations formed therein;

said perforated screen member being corrugated and including a series of rearwardly extending, alternating, elongated grooves and ridges;

said opening defining a bottom edge, a top edge, and opposite side edges;

said radiator grille having a corrugated portion at said bottom edge including a series of alternating grooves and ridges which register with said grooves and ridges in said screen member.

9. The lawn mower of claim 8 wherein said grooves and ridges in said screen member have forward and rearward ends and wherein the rearward ends of said grooves and ridges of said screen member rest upon said grooves and ridges in said corrugated portion of said radiator grille.

10. The lawn mower of claim 8 wherein said forward ends of said grooves and ridges of said screen member are disposed above the rearward ends thereof.

11. The lawn mower of claim 10 wherein said grooves and ridges of said screen member are disposed at an angle with respect to horizontal.

12. The lawn mower of claim 9 wherein said rearward ends of said grooves and ridges of said screen member rest upon said grooves and ridges in said corrugated portion of said radiator grille in an unobstructed manner so that accumulated chaff in said grooves and on said ridges will readily fall therefrom, by gravity, vibration or manual cleaning.

* * * * *